United States Patent [19]

Hagan et al.

[11] Patent Number: 4,617,973

[45] Date of Patent: Oct. 21, 1986

[54] SELTZER FILLING APPARATUS AND PROCESS

[76] Inventors: Richard J. Hagan, 444 Laurel St., San Carlos, Calif. 94070; Dennis A. Lempert, 11642 Dawson Dr., Los Altos Hills, Calif. 94022

[21] Appl. No.: 704,763

[22] Filed: Feb. 20, 1985

[51] Int. Cl.[4] ..... B65B 3/04

[52] U.S. Cl. ..... 141/2; 141/272

[58] Field of Search ..... 141/1-12, 141/14-17, 250-284

[56] References Cited

U.S. PATENT DOCUMENTS

| | | | |
|---|---|---|---|
| 710,674 | 10/1902 | Fassmann | 215/74 |
| 2,185,290 | 2/1940 | Bravo et al. | 215/74 |
| 2,830,745 | 9/1955 | Aicart | 222/394 |
| 4,456,040 | 6/1984 | Bacroix et al. | 141/272 |

*Primary Examiner*—Houston S. Bell, Jr.
*Attorney, Agent, or Firm*—Willis E. Higgins

[57] ABSTRACT

A filling apparatus (20) for a syphon package has a pivotally movable cradle (26A, 26B, 26C) configured to receive a syphon bottle 1 in a first orientation. A permanent syphon filling head (38A, 38B, 38C) is near necked opening (2) of the bottle when the bottle is loaded in the cradle (26A). Arms (28A, 28B, 28C, 30A, 30B, 30C) move the cradle (26A, 26B, 26C) from the first orientation to the second orientation in which the necked opening (2) of the bottle (1) is directed downward. Linkages (42A, 42B, 42C, 44A, 44B, 44C) and plate (40A, 40B, 40C) urge the bottle (1) into engagement with the filling head (38). Rod (106) depresses lever (50) to activate filling head (38) for opening valve (4) in the neck (2) of the bottle (1). Lines (43A, 43B, 43C) supply liquid under pressure to the filling head (38). Lines (45A, 45B, 45C) remove gas from the bottle (1) during filling of the bottle (1) with the liquid (8). Linkages (42A, 42B, 42C, 44A, 44B, 44C) and plate (40A, 40B, 40C) allow bottle (1) to move out of engagement with filling head (38) after valve (4) is closed when cradle (26A, 26B, 26C) is pivoted from the second orientation to the first orientation.

24 Claims, 6 Drawing Figures

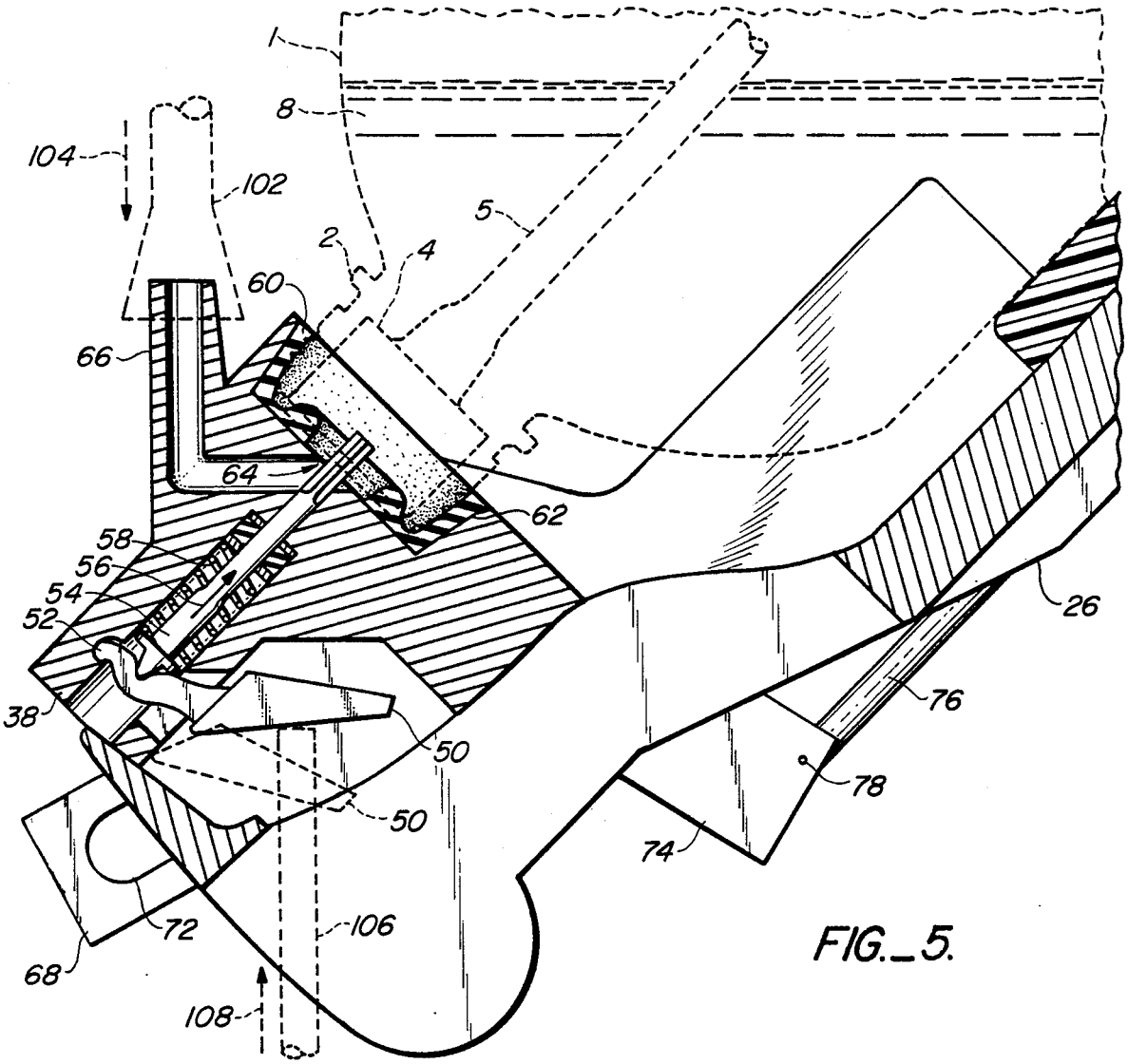
FIG._5.
FIG._6.
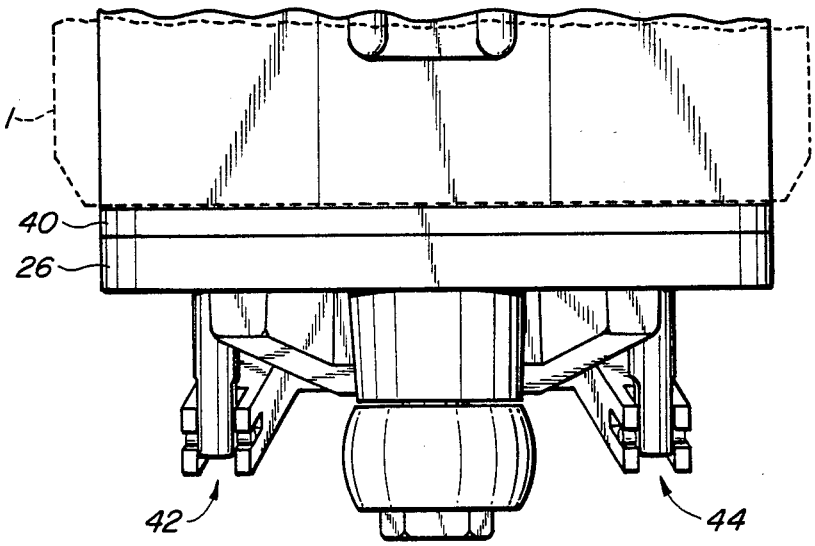

SELTZER FILLING APPARATUS AND PROCESS

CROSS REFERENCE TO RELATED APPLICATIONS

This application and the following copending applications by Richard J. Hagan are directed to related inventions: Ser. No. 06/685,912, filed Dec. 27, 1984 and entitled "Method and Apparatus for Storing and Dispensing Fluids Containered Under Gas Pressure"; Ser. No. 06/635,450, filed July 31, 1984 and entitled "Syphon Assembly and Package Incorporating the Assembly" and Ser. No. 06/687,296, filed Dec. 28, 1984 and entitled "Integral Syphon Package Head".

BACKGROUND OF THE INVENTION

1. Field of the Invention

This invention relates to a modified form of a seltzer bottle filling apparatus and to a process for filling a seltzer bottle having a detachable head with the head detached. More particularly, it relates to such an apparatus and process in which such a seltzer bottle is filled through a valve mechanism that remains on the bottle.

2. Description of the Prior Art

The substantial prior art on syphon seltzer bottle technology is summarized in the related applications. Briefly, conventional seltzer bottles are provided with syphon heads that remain permanently with the bottle. The head and bottle assembly is refilled with seltzer water under pressure for each use. The seltzer bottles and syphon head assemblies are of heavy duty, rugged construction in order to provide strength against the substantial gas pressures of up to 10 atmospheres employed in such seltzer bottles, and also to allow reuse of the syphon head-bottle combination for many years.

The related applications provide, for the first time, an apparatus and method in which the seltzer or other liquid may be packaged under such substantial gas pressure in a recyclable or disposable container.

In the conventional technique for filling seltzer bottles, the head-bottle combination is inverted in a cradle, a nozzle is connected to the spout of the head, the lever of the head is depressed to open the valve disposed in the head, and the seltzer water enters the bottle through the head and the syphon tube. A sequence of fill and sniff operations is carried out by the filling apparatus in order to remove air displaced by the seltzer water as the bottle fills. In order to fill the recyclable or disposable packages disclosed in the related applications, modification of this prior art apparatus and process is required.

SUMMARY OF THE INVENTION

Accordingly, it is an object of this invention to provide apparatus and a process especially adapted to fill syphon packages of the type having a removable head with the head removed.

It is another object of the invention to provide such an apparatus and process which is easily implemented as a modification of commercial filling equipment now in use It is a further object of the invention to provide seltzer filling apparatus and a process using a permanent head that interacts with a valve on a seltzer syphon package without a head to fill the package.

The attainment of these and related objects may be achieved through use of the novel syphon package filling apparatus and process of this invention. A filling apparatus in accordance with this invention includes a cradle movably attached to the apparatus and configured to receive a syphon package in a first orientation. A permanent syphon filling head is attached to the apparatus proximate to a necked opening of the syphon package when the package is loaded in the cradle. A pivoting means mechanically coupled to the cradle moves the cradle from the first orientation to a second orientation in which the necked opening of the syphon package is directed downward. A biasing means activated during the cradle pivoting urges the syphon package into engagement with the permanent syphon filling head. A head activating means activates the head to open a valve in the neck of the syphon package. A source of seltzer water or other liquid under pressure connected to the permanent syphon filling head then fills the syphon package through the syphon head and valve and syphon tube of the package. The valve is then closed and the cradle returned to the first orientation to move the filled syphon package out of engagement with the permanent filling head. In a preferred form of the apparatus, the permanent filling head and the biasing means are on the cradle, so that a modified cradle incorporating these elements may simply replace the conventional cradle on present syphon seltzer bottle filling machines.

This invention provides a simple modification to the apparatus and process conventionally employed for filling syphon seltzer packages with attached heads so that this apparatus and process can be used in modified form to accomodate syphon packages without attached heads. Existing equipment therefore can be used with a new type of package without extensive modification.

The attainment of the foregoing and related objects, advantages and features of the invention should be more readily apparent to those skilled in the art, after review of the following more detailed description of the invention, taken together with the drawings, in which:

BRIEF DESCRIPTION OF THE DRAWINGS

FIG. 5 is an enlarged cross-section view of part of the apparatus portion shown in FIG. 4.

FIG. 6 is a top view of another part of the apparatus portion shown in FIGS. 3 and 4.

DETAILED DESCRIPTION OF THE INVENTION

Figure 1:
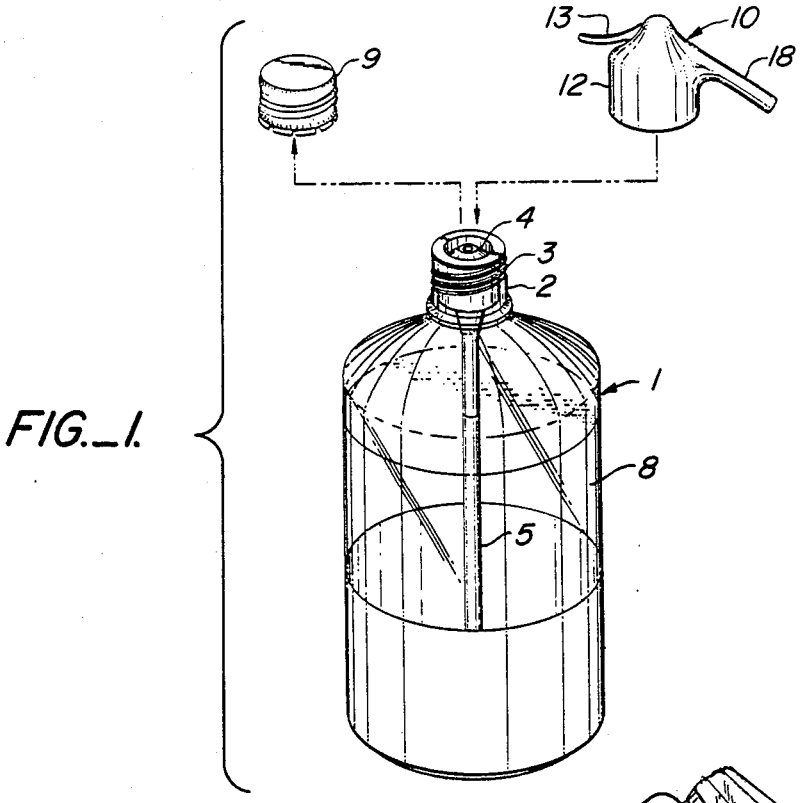
FIG. 1 is a perspective view of a syphon package of a type that is utilized with this invention.

Turning now to the drawings, more particularly to FIG. 1, there is shown a syphon package of the type that is filled with the apparatus and process of this invention. The package stores and dispenses fluids containered under gas pressure and includes a plastic, metal, composite or other substantially non-frangible container 1 capable of safely withstanding in excess of three atmospheres of pressure, preferably a 2.0 liter bottle capable of safely carrying liquids at 150 psi (10 atmospheres). The container is formed with a neck portion 2 having an external attachment member 3. Preferably, the bottle is an 18 to 20 mil polyester terephthalate (PET) bottle. The external attachment member on the outside wall of the neck may be the formation of screw threads 3 in the plastic.

A valve means 4 is mounted substantially within the container neck portion for maintaining gas pressure of at least three atmospheres and preferably up to about 150 psi or about 10 atmospheres. A tube 5, commonly known as a syphon tube, is connected to the valve and has a distal end which extends to a point adjacent to the bottom of the bottle. The container is filled with liquid 8, such as carbonated water pressurized to about 10 atmospheres. The liquid 8 flows up through the hollow syphon tube and through the valve 4 when opened.

A cap 9 removably covering the opening in the neck portion of the bottle is used during storage and shipment of the package. The cap is removed prior to placing head 10 on the bottle and dispensing the liquid 8. The cap 9 preferably is of light weight aluminum formed with internal threads, tamper resistant and recyclable or disposable. The cap is not under pressure, due to the presence of valve 4, unlike all caps for lightly carbonated beverages.

Head 10 is removably affixed by means of internal threads on the wall 12 of head 10 to the threads 3 on the neck portion 2 of the container after removing cap 9. The head member has a manually engageable valve actuating lever 13. A remote valve actuating pin is selectively operable by the valve actuating lever and is positioned inside head 10 for engagement with the valve 4. When valve 4 is opened, the liquid 8 is discharged from spout 18. Further details on various forms of such detachable head syphon packages are available in the above referenced related applications, the disclosures of which are incorporated by reference herein. Since the head 10 is not in place at the time the package is filled with the liquid 8, conventional equipment used to fill syphon packages with permanently attached heads is not suitable for filling this package.

Figure 2:
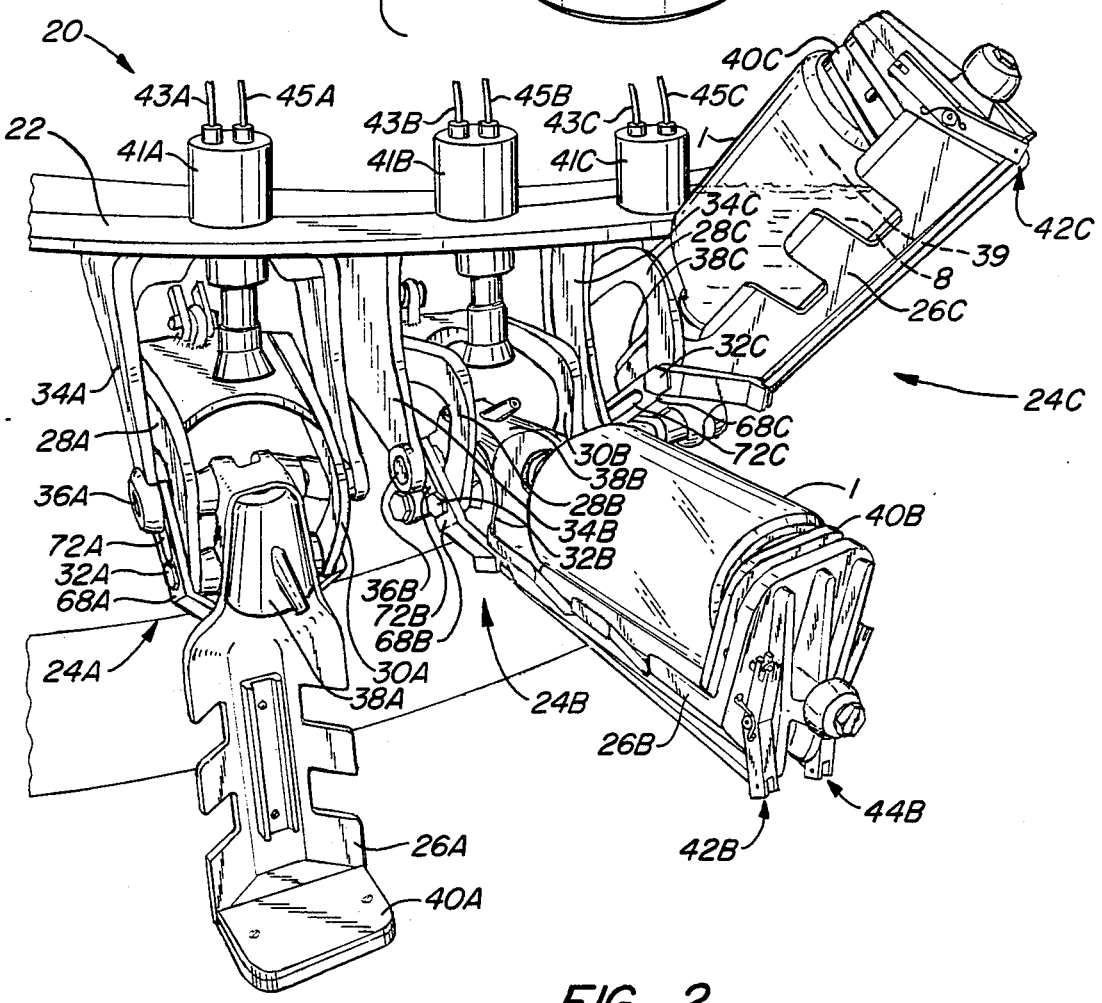
FIG. 2 is a perspective view of a syphon seltzer bottle filling apparatus in accordance with the invention.

FIG. 2 shows a filling apparatus 20 in accordance with the invention for filling the bottles 1. The apparatus 20 has a rotatable frame 22, to which are mounted a plurality of filler stations, such as the stations 24A, 24B and 24C shown in FIG. 2. A typical filling apparatus 20 contains from 8 to 40 of the filler stations 24A–24C. Each of the stations 24A–24C has a cradle 26A, 26B and 26C, configured to receive one of the bottles 1. The cradles 26A–26C are pivotally coupled to arms 28A, 30A, 28B, 30B, 28C and 30C at pivots 32A, 32B and 32C. The cradles 26A–26C are also pivotally coupled to brackets 34A, 34B and 34C at pivot points 36A, 36B and 36C. The cradles 26A–26C each have a head, such as the heads 38A and 38B visible in FIG. 2, above the bottle receiving area of the cradles 26A–26C. The cradles 26A–26C have movable platforms 40A, 40B and 40C engaging the bottom of the bottles 1. The movable platforms 40A–40C are connected to the pivot points 32A–32C by linkages 42A, 44A, 42B, 44B, 42C and 44C. The linkages 42A–44C serve to urge the bottles 1 against the heads 38A–38C when the cradles 26A–26C are raised to the position shown at 26C. Filling apparatus of the general type shown, but only capable of filling conventional syphon bottles with attached heads, is commercially available from Marcel S.A., Buenos Aires, Argentina.

In operation, the bottles 1 are loaded in the cradles 26A–26C when they are in the vertical position shown for cradle 26A. The arms 28A–28CC are raised as sequentially shown for cradles 26B and 26C to pivot the cradle through a horizontal position shown at 26B to the raised position shown at 26C. Lines 43A, 43B and 43C are connected to a source of liquid 8 under pressure and to valves 41A, 41B and 41C. Lines 45A, 45B and 45C are connected to vent entrapped air and other gas 39 from the bottles 1 as they are filled. Lines 45A, 45B and 45C are also connected to valves 41A, 41B and 41C. The valves 41A, 41B and 41C are controlled to switch between the lines 43A, 43B, 43C and the lines 45A, 45B, 45C to carry out the alternate fill and sniff cycles.

Figure 4:
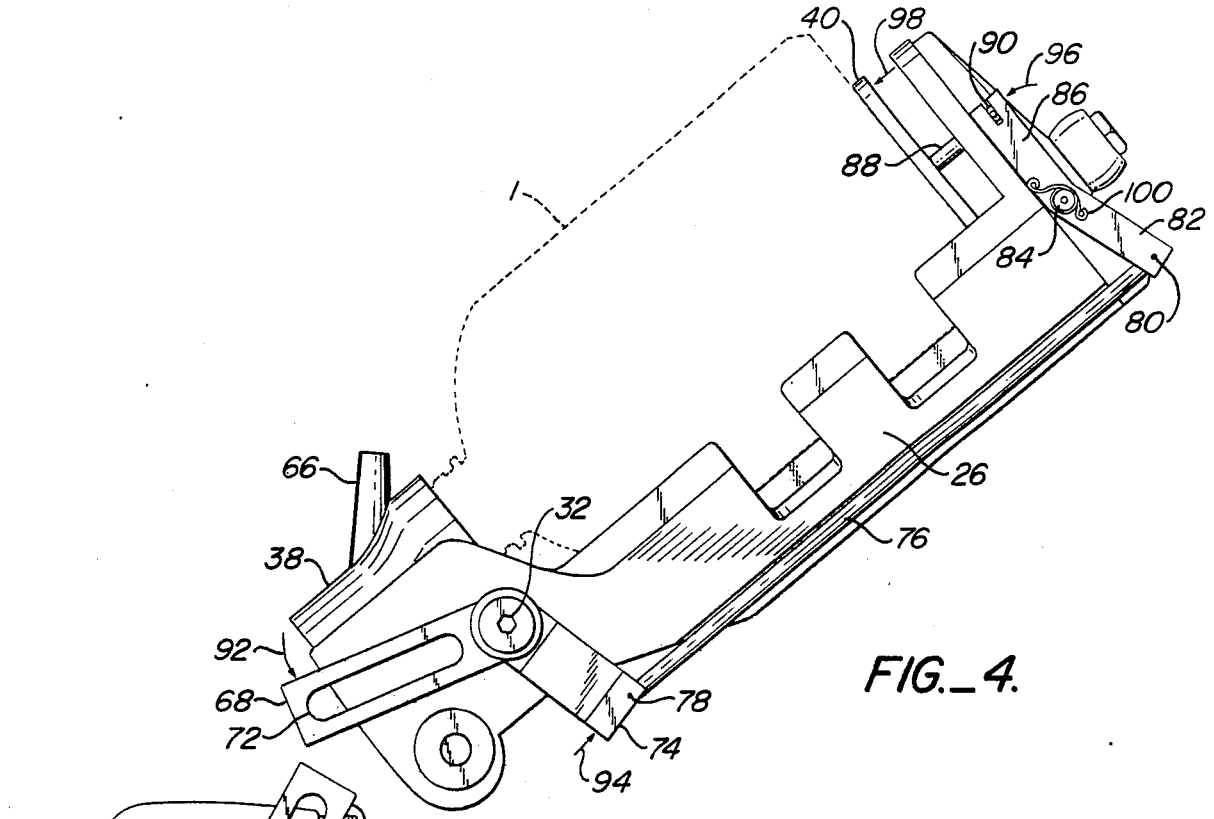
FIG. 4 is a similar side view of the apparatus portion shown in FIG. 3, but in a different operating position.
Figure 3:
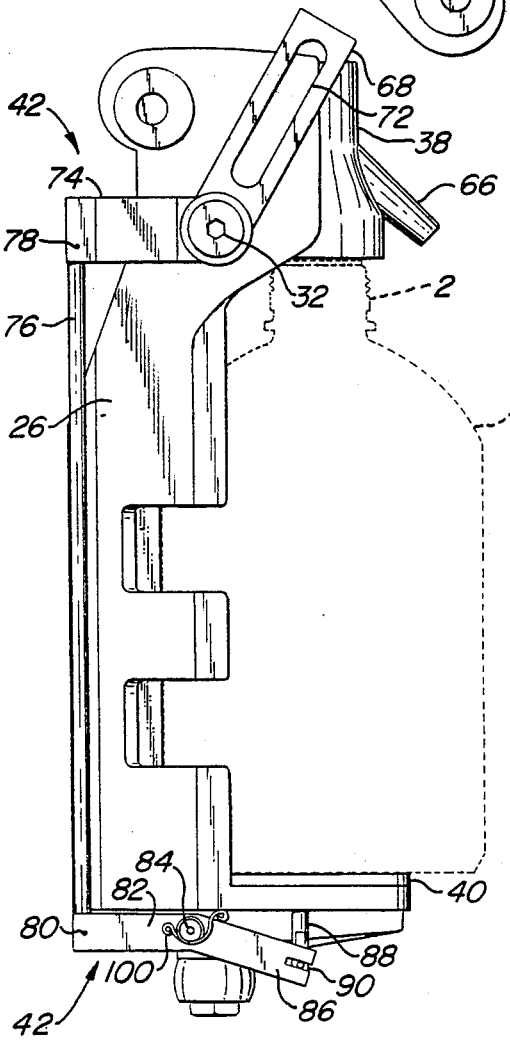
FIG. 3 is a side view of a portion of the apparatus of FIG. 2.

FIGS. 3–5 show further details of the cradle 26. Since corresponding elements are present on each of the cradles 26A–26C shown in FIG. 2, the letter designations following each reference number will not be employed in the following discussion of FIGS. 3–6. FIG. 3 shows the cradle 26 in its orientation for loading the bottle 1 for filling, and also for unloading the bottle 1 after it has been filled. FIG. 4 shows the cradle 26 after it has been raised to the position for filling the bottle 1. Head 38 is permanently attached to the cradle 26 so that it rests above the bottle 1 when the cradle 26 is in the position shown in FIG. 3. The head 38 contains the same functional elements as the head 10 of FIG. 1 that the user attaches to the neck 2 of the bottle prior to discharging the liquid 8. Lever 50 is pivotally attached to the head 10 at 52, so that force to move the lever to the position shown in solid line in FIG. 5 moves actuating rod 54 in the direction shown by arrow 56 to open the valve 4 in neck 2 of the bottle 1. Spring 58 biases the actuating rod 54 to the position shown in dotted line in FIG. 5, where it will not engage the valve 4. Unlike the head 10 in FIG. 1, the head 38 has a resilient seat 60 formed from polytetrafluoroethylene or other durable, resilient material lining cavity 62 to form an effective seal with the neck 2 of the bottle when the bottle is urged against the head 38 by the plate 40. The seat 60 and cavity 62 have a centrally disposed aperture 64 communicating with spout 66 so that liquid may enter the bottle 1 through the head 38.

Linkage 42 for activating plate 40 to urge bottle 1 against the head 38 has a first lever 68 pivotally attached to the cradle 26 at 32. Slot 72 of the lever 68 is pivotally attached to pivot point 36 of bracket 34 (FIG. 2). Lever 68 is angled, with a second portion 74 extending from the pivot 32. Portion 74 of the lever 68 is pivotally attached to rod 76 at 78. Rod 76 is also pivotally attached at 80 to a second angled lever 82. Lever 82 is in turn pivotally attached to the cradle 26 at 84. Portion 86 of the angled lever 82 is pivotally attached to rod 88 at 90. Rod 88 is fixedly attached to the plate 40. Linkage 44 (FIGS. 2 and 6) contains corresponding elements and therefore will not be described further. If desired, one or more of the members comprising the linkages 42 and 44 can be made adjustable in length to provide increased tolerance in the mechanism.

In operation, when the cradle 26 is raised to the position shown in FIGS. 4 and 5, lever 68, rod 76, and lever 82 pivot from force applied to the lever 68 by bracket 34, as indicated by arrows 92, 94 and 96 so that rod 88 forces plate 40 against the bottle 1. Neck 2 of the bottle 1 moves into sealing engagement with the head 38, as indicated by arrow 98. In practice, the plate 40 should apply a pressure of from about 150 to 200 psi against the bottle 1 for this purpose. A tension spring 100 can be provided connecting the pivot 84 and the lever 82 to limit the pressure to this amount.

FIG. 5 shows the bottle 1 with its neck 2 in sealing engagement with the seat 60 of head 38, and the head 38 activated to open valve 4, so that the liquid 8 may enter the bottle through the head 38, valve 4 and syphon tube 5. After the bottle 1 has been inverted by moving cradle 26 to the position shown in FIGS. 4 and 5, fitting 102 is moved down as indicated by arrow 104 to engage the spigot 66. Fitting 102 is connected to valve 41 (FIG. 2) Rod 106 is then moved upward, as indicated by arrow 108, to move the lever 50 from the position indicated in dotted line in FIG. 5 to the position there shown in solid line. Rod 54 is therefore activated to open valve 4, thus allowing the pressurized liquid 8 to enter the bottle 1. As is conventional in syphon package filling, the fitting 102 is alternately connected by the valve 41 to receive the liquid 8 from line 43 for filling the bottle and to the exhaust line 45 for removing gas trapped in the bottle 1 above the liquid 8 through the syphon tube 5. This mode of filling is referred to in the seltzer industry as alternate fill and sniff cycles. When the bottle 1 has been filled, rod 106 is lowered so that rod 54 may move out of engagement with valve 4, allowing the valve to close. Fitting 102 is then disconnected from the spigot 66, and the cradle 26 returned to the position shown in FIG. 3 for removal of the filled bottle.

FIG. 6 shows the tandem linkages 42 and 44 on either side of the cradle 26. Providing the linkages 42 and 44 in tandem assures even application of force across the surface of plate 40 against the bottle 1, giving reliable operation and preventing uneven wear of the cradle assembly.

It should now be readily apparent to those skilled in the art that a novel filling apparatus, attachment for a filling apparatus and process capable of achieving the stated objects of the invention has been provided. The filling apparatus of this invention fills syphon packages having a removable head with the head removed. The cradle assembly of this invention allows ready modification of commercially available syphon package filling equipment designed for filling syphon packages with permanently attached heads to fill the removable head syphon packages with the head removed. The process of this invention fills such packages in an efficient manner.

It should further be apparent to those skilled in the art that various changes in form and details of the invention as shown and described may be made. It is intended that such changes be included within the spirit and scope of the claims appended hereto.

What is claimed is:

1. A filling apparatus for a syphon package having a normally closed valve in a necked opening of the package, which comprises a pivotally movable cradle configured to receive a syphon package in a first orientation, a permanent syphon filling head attached to said apparatus proximate to the necked opening of the syphon package when the package is loaded in said cradle, said permanent syphon filling head including means for applying a valve opening force to the valve in the necked opening of the package, a pivoting means mechanically coupled to the cradle for moving said cradle from the first orientation to a second orientation in which the necked opening of the syphon package is directed downward, a biasing means configured to be activated during the cradle pivoting to urge the syphon package into engagement with said permanent syphon filling head, a head activating means coupled to said permanent syphon filling head to activate said valve opening force applying means for opening the valve in the neck of the syphon package, a source of liquid under pressure connected to said permanent syphon filling head, and means also connected to said permanent syphon filling head for removing gas from the syphon package during filling of the syphon package with the liquid, said biasing means being configured to allow the syphon package to move out of engagement with said permanent syphon filling head when said movable cradle is pivoted from the second orientation to the first orientation.

2. The filling apparatus of claim 1 in which said permanent syphon filling head is fixedly attached to said cradle.

3. The filling apparatus of claim 1 in which said biasing means comprises a plate movably mounted on said cradle to engage a bottom of the syphon package, and a first linkage mechanically connected to urge said plate against the bottom of the syphon package.

4. The filling apparatus of claim 3 in which said biasing means includes a second linkage mechanically connected to urge said plate against the bottom of the syphon package in tandem with said first linkage.

5. The filling apparatus of claim 3 in which said first linkage is configured to supply up to a predetermined amount of biasing force to the syphon package.

6. The filling apparatus of claim 1 in which said permanent syphon filling head has a seat having a layer of resilient material, said seat being configured to receive the neck of the syphon package in sealing engagement against the resilient material layer.

7. An attachment for converting a filling apparatus configured to fill a syphon package having a head mounted on the package to a filling apparatus for filling a syphon package having a normally closed valve in a necked opening of the package and being configured for subsequent attachment of a detachable head, which comprises a cradle configured to be pivotally attached to the filling apparatus, said cradle being configured to receive the syphon package in a first orientation, a permanent syphon filling head attached to said cradle proximate to the necked opening of the syphon package when the package is loaded in said cradle, said permanent syphon filling head including means for applying a valve opening force to the valve in the necked opening of the package, said valve opening force applying means being configured to be engaged by a head activating means on the filling apparatus to activate said valve opening force applying means for opening the valve in the neck of the syphon package, said permanent syphon head being configured to be connected to a source of liquid under pressure and a means for removing gas from the syphon package during filling of the syphon package with the liquid on the filling apparatus, a biasing means actuable to urge the syphon package into engagement with said permanent syphon filling head, said cradle being configured to be engaged by a pivoting means on the filling apparatus for moving said cradle from a first orientation to a second orientation in which the necked opening of the syphon package is directed downward, said biasing means being configured to urge the syphon package against said permanent syphon filling head when said cradle is moved from the first orientation to the second orientation and to allow the syphon package to move out of engagement with said permanent syphon filling head when said movable cradle is pivoted from the second orientation to the first orientation.

8. The filling apparatus of claim 7 in which said biasing means comprises a plate movably mounted on said cradle to engage a bottom of the syphon package, and a first linkage configured to connect said plate to the pivoting means.

9. The filling apparatus of claim 8 in which said biasing means includes a second linkage mechanically connected to urge said plate against the bottom of the syphon package in tandem with said first linkage.

10. The filling apparatus of claim 8 in which said first linkage is configured to supply up to a predetermined amount of biasing force to the syphon package.

11. The filling apparatus of claim 7 in which said permanent syphon filling head has a seat having a layer of resilient material, said seat being configured to receive the neck of the syphon package in sealing engagement against the resilient material layer.

12. A filling apparatus for a syphon package, which comprises a cradle configured to receive a syphon package having a necked opening with a normally closed valve in the necked opening, a permanent syphon filling head attached to said apparatus proximate to a necked opening of the syphon package when the package is loaded in said cradle, said permanent syphon filling head having a seat with a layer of resilient material, said seat being configured to receive the neck of the syphon package in sealing engagement against the resilient material layer, said permanent system filling head having a means for applying a valve opening force to the valve in the necked opening, a biasing means actuable to urge the syphon package into engagement with said permanent syphon filling head, a head activating means coupled to said permanent syphon filling head to activate said valve opening force applying means for opening the valve in the neck of the syphon package, and a source of liquid under pressure connected to said permanent syphon filling head.

13. The filling apparatus of claim 12 in which said permanent syphon filling head is fixedly attached to said cradle.

14. The filling apparatus of claim 12 in which said biasing means comprises a plate movably mounted on said cradle to engage a bottom of the syphon package, and a first linkage mechanically connected to urge said plate against the bottom of the syphon package.

15. The filling apparatus of claim 14 in which said biasing means includes a second linkage mechanically connected to urge said plate against the bottom of the syphon package in tandem with said first linkage.

16. The filling apparatus of claim 14 in which said first linkage is configured to supply up to a predetermined amount of biasing force to the syphon package.

17. The apparatus of claim 12 additionally comprising means connected to said permanent syphon filling head for removing gas from the syphon package during filling of the syphon package with the liquid.

18. An attachment for converting a filling apparatus configured to fill a syphon package having a head mounted on the package to a filling apparatus for filling a syphon package having a normally closed valve in a necked opening of the package and being configured for subsequent attachment of a detachable head, which comprises a cradle configured to be attached to the filling apparatus, said cradle being configured to receive the syphon package, a permanent syphon filling head attached to said cradle proximate to the necked opening of the syphon package when the package is loaded in said cradle, said permanent syphon filling head having a means for applying a valve opening force to the valve in the necked opening, said permanent syphon filling head being configured to be engaged by a head activating means on the filling apparatus to activate said valve opening force applying means for opening the valve in the neck of the syphon package and to be connected to a source of liquid under pressure, said permanent syphon filling head having a seat with a layer of resilient material, said seat being configured to receive the neck of the syphon package in sealing engagement against the resilient material layer, and a biasing means actuable to urge the syphon package into engagement with said permanent syphon filling head.

19. The filling apparatus of claim 18 in which said biasing means comprises a plate movably mounted on said cradle to engage a bottom of the syphon package, and a first linkage configured to apply force to said plate.

20. The filling apparatus of claim 19 in which said biasing means includes a second linkage mechanically connected to urge said plate against the bottom of the syphon package in tandem with said first linkage.

21. The filling apparatus of claim 19 in which said first linkage is configured to supply up to a predetermined amount of biasing force to the syphon package.

22. A process for filling a syphon package having a necked opening and a normally closed valve in the necked opening with a liquid, which comprises positioning said syphon package proximate to a head configured to engage the necked opening, the head including a means for applying a valve opening force to the valve in the necked opening, orienting the syphon package so that the necked opening faces downward, urging the syphon package into engagement with the head, activating the valve opening force applying means to open the valve, supplying the liquid through the head, the valve and the syphon of the package to the syphon package, closing the valve, and allowing the filled syphon package to move out of engagement with the head.

23. The process of claim 22 additionally comprising the step of periodically removing gas through the syphon of the package and the head.

24. A process for filling a syphon package having a necked opening and a normally closed valve in the necked opening with a liquid, which comprises positioning said syphon package proximate to a head configured to engage the necked opening, the head including a means for applying a valve opening force to the valve in the necked opening, urging the syphon package into engagement with the head, activating the valve opening force applying means to open the valve, supplying the liquid through the head, the valve and the syphon of the package to the syphon package, periodically removing gas through the syphon of the syphon package, the valve and the head, closing the valve, and allowing the filled syphon package to move out of engagement with the head.

* * * * *